US012295502B2

(12) United States Patent
Mountz

(10) Patent No.: US 12,295,502 B2
(45) Date of Patent: May 13, 2025

(54) COLLAPSIBLE INFANT PLAYPEN

(71) Applicant: Wonderland Switzerland AG, Steinhausen (CH)

(72) Inventor: Jonathan K. Mountz, Birdsboro, PA (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 383 days.

(21) Appl. No.: 17/789,975

(22) PCT Filed: Dec. 29, 2020

(86) PCT No.: PCT/EP2020/087983

§ 371 (c)(1),
(2) Date: Jun. 29, 2022

(87) PCT Pub. No.: WO2021/136782

PCT Pub. Date: Jul. 8, 2021

(65) Prior Publication Data

US 2023/0031002 A1 Feb. 2, 2023

Related U.S. Application Data

(60) Provisional application No. 62/954,971, filed on Dec. 30, 2019.

(51) Int. Cl.
*A47D 13/06* (2006.01)

(52) U.S. Cl.
CPC ..... *A47D 13/063* (2013.01)

(58) Field of Classification Search
CPC .... A47D 13/06; A47D 13/061; A47D 13/063; A47D 13/065; A47D 13/066; A47D 13/068
See application file for complete search history.

(56) References Cited

U.S. PATENT DOCUMENTS

2007/0017025 A1* 1/2007 Myer ..... A47D 7/002 5/99.1
2008/0189854 A1* 8/2008 Thorne ..... A47D 13/061 5/99.1

(Continued)

FOREIGN PATENT DOCUMENTS

CN 102028368 A 4/2011
CN 106667140 A 5/2017
CN 208048461 U 11/2018

OTHER PUBLICATIONS

International Search Report and Written Opinion for PCT/EP2020/087983 dated Mar. 18, 2021.

*Primary Examiner* — George Sun
(74) *Attorney, Agent, or Firm* — Volpe Koenig

(57) ABSTRACT

An infant playpen includes an upper frame portion having a pivot joint and two side segments, a latching device disposed adjacent to the pivot joint, a standing post connected with the upper frame portion and carrying a cable actuator and a resilient part, a cable assembly respectively connected with the latching device and the cable actuator, and a bottom linkage portion including a bar segment pivotally connected with a foot portion of the standing post. The latching device has a locking state for locking the two side segments in an unfolded state, and an unlocking state for rotation of the two side segments between the unfolded state and a folded state. The resilient part can bias the cable actuator toward an initial position, and the bar segment is rotatable to urge the cable actuator in movement away from the initial position for switching the latching device to the unlocking state.

15 Claims, 9 Drawing Sheets

(56) References Cited

U.S. PATENT DOCUMENTS

| | | | | |
|---|---|---|---|---|
| 2008/0196163 | A1* | 8/2008 | Thorne | A47D 13/063 5/99.1 |
| 2013/0277948 | A1* | 10/2013 | Thorne | A47D 13/063 280/639 |
| 2016/0338506 | A1* | 11/2016 | Yang | A47D 13/063 |
| 2017/0290444 | A1* | 10/2017 | Mao | A47D 13/063 |
| 2018/0008056 | A1* | 1/2018 | Yang | F16B 7/14 |
| 2019/0142183 | A1* | 5/2019 | Mountz | A47D 13/063 5/99.1 |
| 2020/0281369 | A1* | 9/2020 | Juchniewicz | A47D 13/063 |

* cited by examiner

100

COLLAPSIBLE INFANT PLAYPEN

CROSS-REFERENCE TO RELATED APPLICATION(S)

This application is a 371 National Stage Entry of International Application No. PCT/EP2020/087983 filed on Dec. 29, 2020, which claims priority to U.S. Provisional Application No. 62/954,971 filed on Dec. 30, 2019, the disclosures of which are both entirely incorporated herein by reference.

BACKGROUND

1. Field of the Invention

The present invention relates to infant playpens.

2. Description of the Related Art

Most playpen frames currently available on the market include four feet that are connected to vertical tubes, which are in turn connected with top rail corners. The top rail corners are connected with four top rails each of which being provided with a latch. Moreover, the feet are further connected to a center hub through multiple bar linkages.

To erect the playpen for use, a caregiver usually needs to first deploy the top rails and engage all the four latches on the top rails. Then the center hub can be engaged to erect the bottom half of the frame. To fold the frame, the aforementioned steps must be reversed: the center hub is first disengaged, which collapses the bottom half of the frame, and then each of the latches on the top rails can be disengaged for collapsing the top half of the frame. In other words, multiple operating steps are required for folding the playpen, which may be difficult to caregivers.

Therefore, there is a need for an improved playpen that is more convenient in use, and can address at least the foregoing issues.

SUMMARY

The present application describes an infant playpen that is more convenient to operate and can address the foregoing problems.

According to one embodiment, the infant playpen includes an upper frame portion having a pivot joint and a first and a second side segment, a latching device disposed adjacent to the pivot joint, a standing post connected with the upper frame portion and carrying a cable actuator and a resilient part, a cable assembly respectively connected with the latching device and the cable actuator, and a bottom linkage portion including a bar segment pivotally connected with a foot portion of the standing post. The latching device is switchable between a locking state for locking the first and the second side segments in an unfolded state, and an unlocking state for rotation of the first and the second side segments between the unfolded state and a folded state. The resilient part applies a biasing force on the cable actuator for biasing the cable actuator toward an initial position, and the bar segment is rotatable relative to the foot portion to urge the cable actuator in movement away from the initial position and thereby cause the latching device to switch from the locking state to the unlocking state.

According to another embodiment, the infant playpen includes an upper frame portion having a first and a second side segment respectively connected pivotally with a pivot joint, a latching device including a first and a second latch disposed adjacent to the pivot joint, the first latch being engaged with the first side segment and the second latch engaged with the second side segment for locking the first and second side segments in an unfolded state, and the first latch being disengaged from the first side segment and the second latch disengaged from the second side segment for rotation of the first and the second side segments between the unfolded state and a folded state, a standing post connected with the upper frame portion and carrying a cable actuator, a cable assembly respectively connected with the cable actuator, the first latch and the second latch, the cable assembly extending along the second side segment and the standing post, and a bottom linkage portion including a bar segment pivotally connected with a foot portion of the standing post. The bar segment is rotatable relative to the foot portion to urge the cable actuator in movement and thereby cause the first latch and the second latch to respectively disengage from the first side segment and the second side segment.

DETAILED DESCRIPTION OF THE EMBODIMENTS

Figure 1:
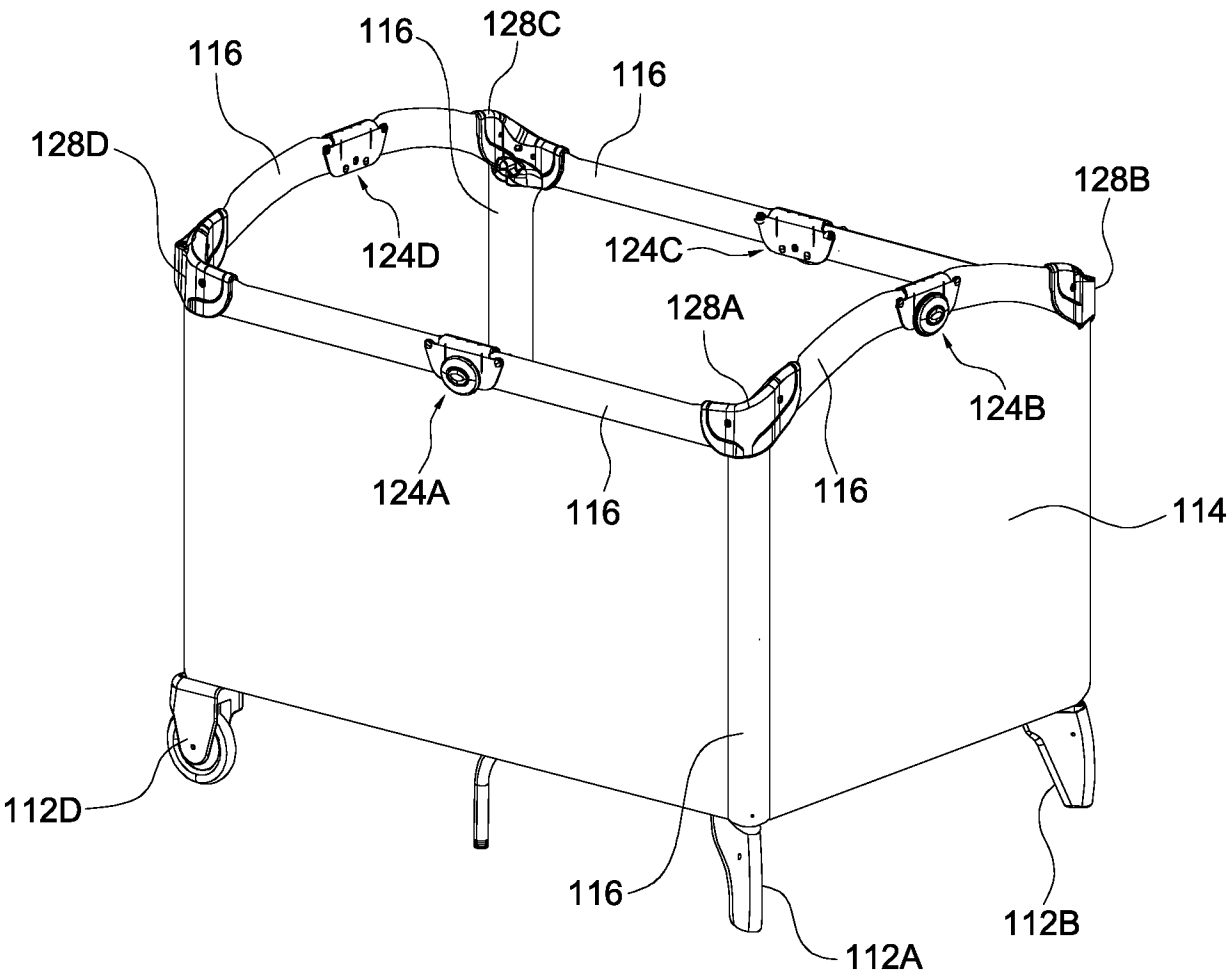
FIG. 1 is a perspective view illustrating one embodiment of a collapsible infant playpen.
Figure 2:
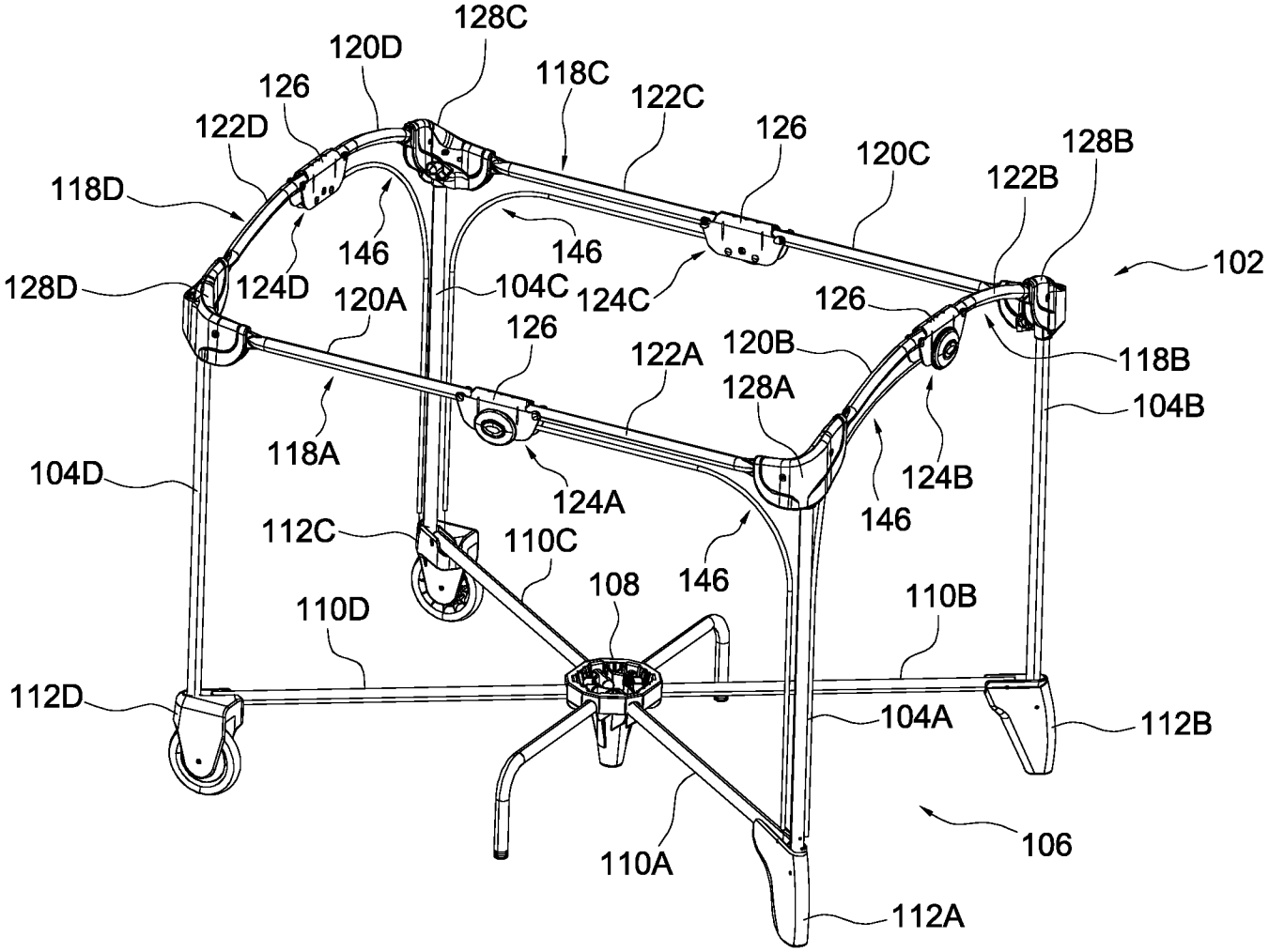
FIG. 2 is a perspective view illustrating a frame structure of the infant playpen shown in FIG. 1.

FIG. 1 is a perspective view illustrating an embodiment of an infant playpen 100, and FIG. 2 is a perspective view illustrating a frame structure of the infant playpen 100. Referring to FIGS. 1 and 2, the infant playpen 100 can include an upper frame portion 102, a plurality of (e.g., four) standing posts 104A, 104B, 104C and 104D, and a bottom linkage portion 106. The upper frame portion 102 can be coupled to upper end portions of the standing posts 104A, 104B, 104C and 104D. The bottom linkage portion 106 can include a central hub 108, and a plurality of (e.g., four) bar segments 110A, 110B, 110C and 110D that are respectively connected pivotally with the central hub 108. Moreover, the bar segments 110A, 110B, 110C and 110D are respectively connected pivotally with a plurality of foot portions 112A, 112B, 112C and 112D that are respectively provided at lower ends of the standing posts 104A, 104B, 104C and 104D. An enclosure 114 can be stretched between the standing posts 104A, 104B, 104C and 104D to surround an inner space of the infant playpen 100 where a young child can be received. The enclosure 114 can be formed by the assembly of one or more fabric, and can have an upper end secured with the upper frame portion 102. Moreover, the enclosure 114 can have a plurality of sleeve portions 116, and the upper frame portion 102 and the standing posts 104A, 104B, 104C and 104D can be at least partially received in the sleeve portions 116.

The upper frame portion 102 can be formed by the assembly of multiple tube segments defining a closed shape. According to an example of construction, the upper frame portion 102 can include four frame assemblies 118A, 118B, 118C and 118D that respectively define four sides of the upper frame portion 102. At each side of the upper frame portion 102, the frame assembly 118A, 118B, 118C or 118D may be formed by two side segments that are respectively connected pivotally with a pivot joint. For example, the frame assembly 118A can include two side segments 120A and 122A that are respectively connected pivotally with a pivot joint 124A, the frame assembly 118B can include two side segments 120B and 122B that are respectively connected pivotally with a pivot joint 124B, the frame assembly 118C can include two side segments 120C and 122C that are respectively connected pivotally with a pivot joint 124C, and the frame assembly 118D can include two side segments 120D and 122D that are respectively connected pivotally with a pivot joint 124D. The side segments 120A-120D and the side segments 122A-122D can exemplarily include tube segments.

According to an example of construction, the pivot joint 124A can include a bracket 126 that is respectively connected pivotally with the two side segments 120A and 122A, whereby the side segments 120A and 122A can rotate relative to each other and the bracket 126 between an unfolded state and a folded state. The side segments 120A and 122A can generally extend horizontally at two opposite sides of the bracket 126 in the unfolded state, and can generally extend vertically and parallel to each other in the folded state. In the folded state, the side segments 120A and 122A and the bracket 126 can form a generally U-shape. The other pivot joints 124B, 124C and 124D can have a similar construction.

Referring to FIGS. 1 and 2, the upper frame portion 102 can further include a plurality of pivot joints that connect the frame assemblies 118A, 118B, 118C and 118D with one another, wherein these pivot joints can include corner brackets 128A, 128B, 128C and 128D. For example, the corner bracket 128A can be respectively connected pivotally with the side segments 122A and 120B, the corner bracket 128B can be respectively connected pivotally with the side segments 122B and 120C, the corner bracket 128C can be respectively connected pivotally with the side segments 122C and 120D, and the corner bracket 128D can be respectively connected pivotally with the side segments 122D and 120A. With this construction, the upper frame portion 102 can have four foldable sides: a first side can be defined between the two corner brackets 128A and 128B and can have the pivot joint 124B at a middle thereof, a second side can be defined between the two corner brackets 128B and 128C and can have the pivot joint 124C at a middle thereof, a third side can be defined between the two corner brackets 128C and 128D and can have the pivot joint 124D at a middle thereof, and a fourth side can be defined between the two corner brackets 128D and 128A and can have the pivot joint 124A at a middle thereof.

Referring to FIGS. 1 and 2, the standing posts 104A, 104B, 104C and 104D can have upper ends respectively connected fixedly with the corner brackets 128A, 128B, 128C and 128D of the upper frame portion 102, and the foot portions 112A, 112B, 112C and 112D of the standing posts 104A, 104B, 104C and 104D can be respectively connected pivotally with the bar segments 110A, 110B, 110C and 110D of the bottom linkage portion 106. The two bar segments 110A and 110C can extend along one diagonal of the bottom linkage portion 106, the bar segments 110B and 110D can extend along another diagonal of the bottom linkage portion 106, and the central hub 108 can be respectively connected pivotally with the bar segments 110A, 110B, 110C and 110D at a center of the bottom linkage portion 106.

For folding the infant playpen 100, the central hub 108 of the bottom linkage portion 106 can be lifted to draw the standing posts 104A, 104B, 104C and 104D toward one another, which causes the frame assemblies 118A, 118B, 118C and 118D of the upper frame portion 102 to respectively fold about the pivot joints 124A, 124B, 124C and 124D. For unfolding the infant playpen 100, the frame assemblies 118A, 118B, 118C and 118D of the upper frame portion 102 can be unfolded, the central hub 108 of the bottom linkage portion 106 can be lowered and the standing posts 104A, 104B, 104C and 104D can be displaced away from one another.

Figure 3:
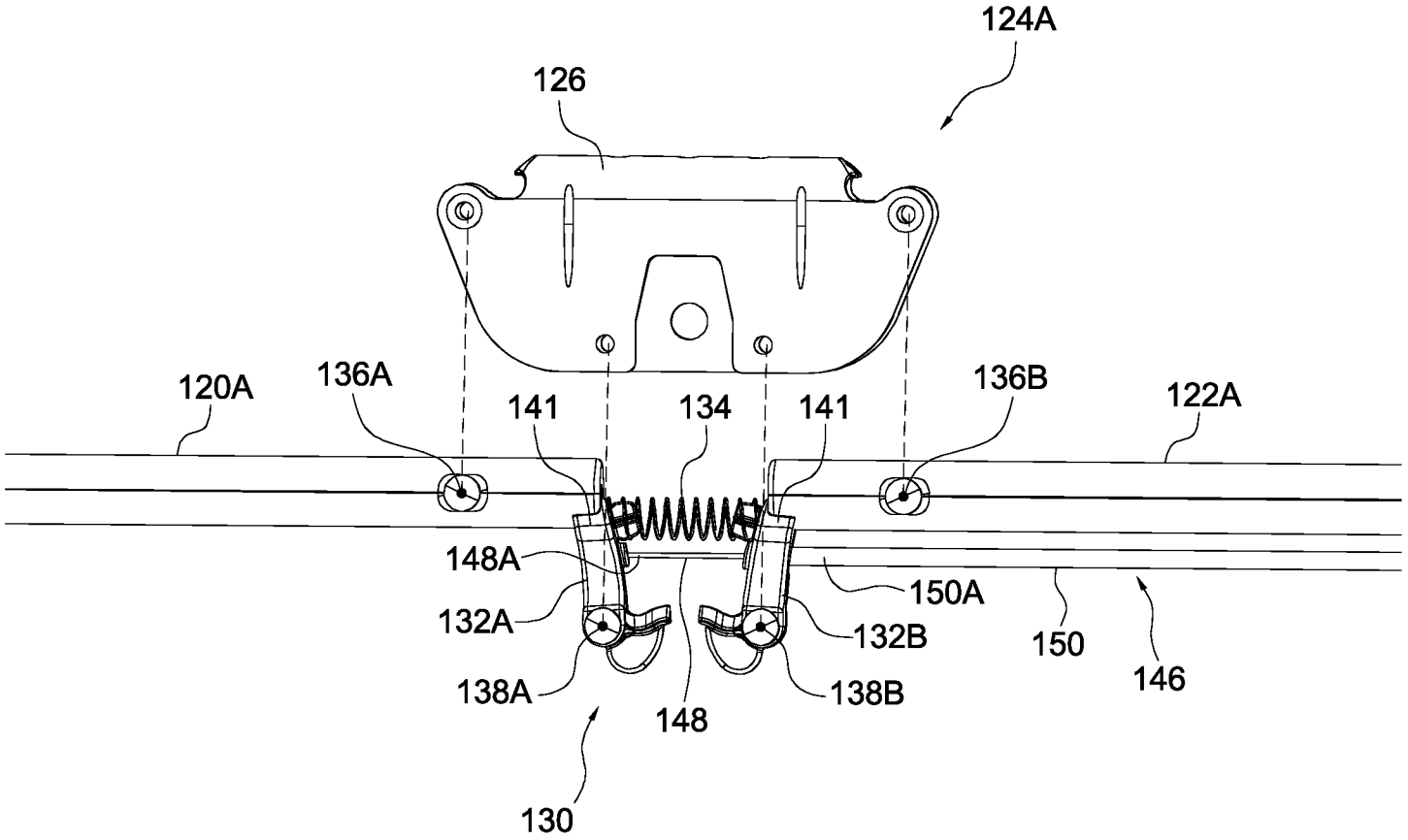
FIG. 3 is a schematic view illustrating construction details of a latching device disposed adjacent to a pivot joint in an upper frame portion of the infant playpen.
Figure 4:
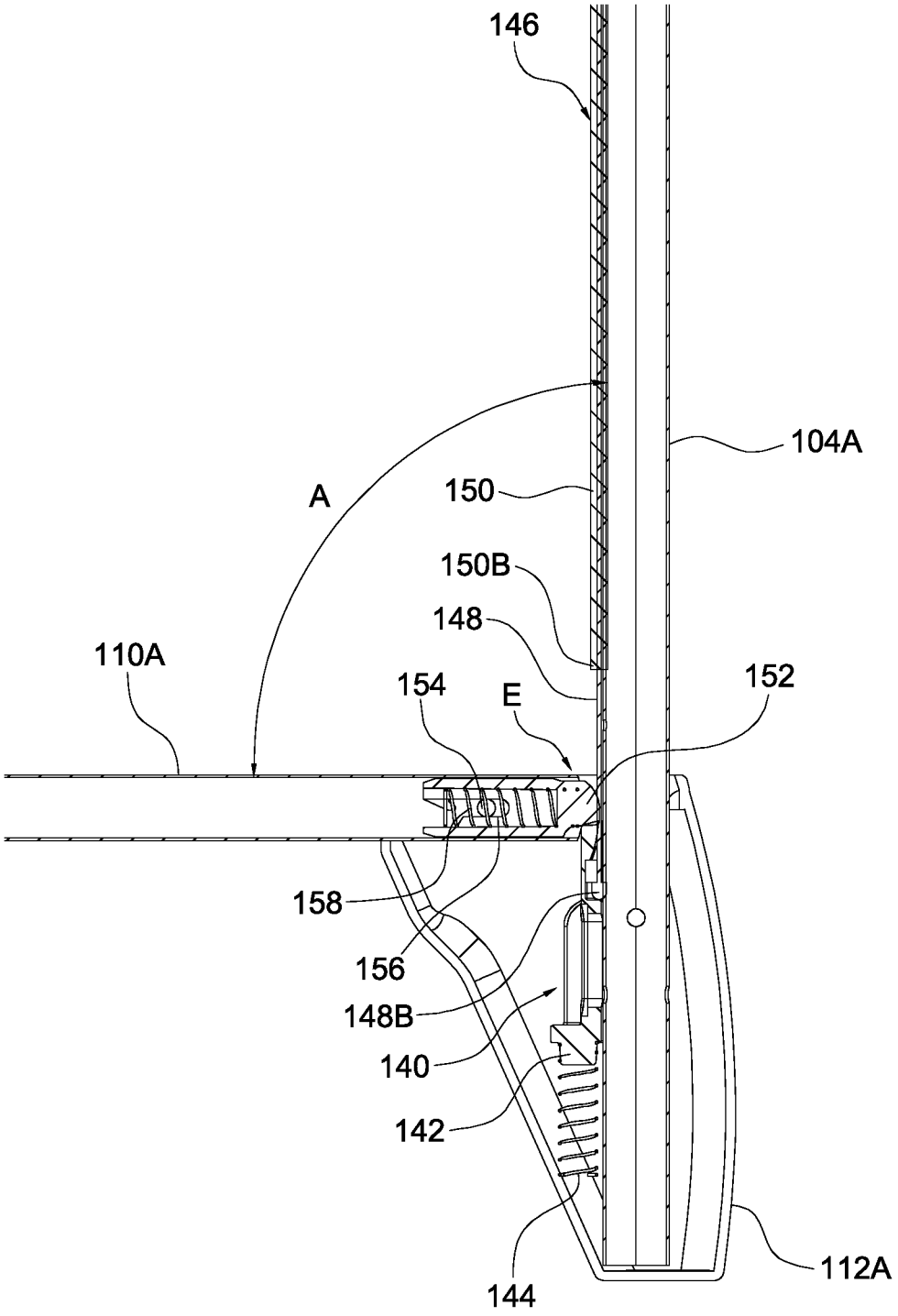
FIG. 4 is a schematic view illustrating a linking mechanism that can operatively couple the latching device to a bottom linkage portion of the infant playpen.

In conjunction with FIGS. 1 and 2, FIG. 3 is a schematic view illustrating construction details of a latching device 130 disposed adjacent to the pivot joint 124A, and FIG. 4 is a partial cross-sectional view illustrating a linking mechanism 140 that can operatively couple the latching device 130 to the bottom linkage portion 106. Referring to FIGS. 1-3, the latching device 130 is switchable between a locking state for locking the two side segments 120A and 122A in the unfolded state, and an unlocking state for rotation of the two side segments 120A and 122A between the unfolded state and the folded state. According to an example of construction, the latching device 130 includes two latches 132A and 132B and a spring 134.

The two latches 132A and 132B are carried with the bracket 126 of the pivot joint 124A, and can move to respectively engage with or respectively disengage from the two side segments 120A and 122A. For example, the latch 132A can be engaged with the side segment 120A and the latch 132B engaged with the side segment 122A in the locking state, and the latch 132A can be disengaged from the side segment 120A and the latch 132B disengaged from the side segment 122A in the unlocking state. According to an example of construction, the two side segments 120A and 122A can be respectively connected pivotally with the bracket 126 about two spaced-apart pivot axes 136A and 136B, and the two latches 132A and 132B can be respectively connected pivotally with the bracket 126 about two spaced-apart pivot axes 138A and 138B that are located below the pivot axes 136A and 136B. The two latches 132A and 132B can thereby respectively rotate about the pivot axes 138A and 138B between the locking state and the unlocking state. According to an example of construction, the latches 132A and 132B can be similar in construction, each having a locking end 141. The locking ends 141 of the two latches 132A and 132B can move away from each other and respectively engage with ends of the two side segments 120A and 122A when the latches 132A and 132B rotate to the locking state, and can move toward each other and respectively disengage from the ends of the two side segments 120A and 122A when the latches 132A and 132B rotate to the unlocking state.

The spring 134 can bias the two latches 132A and 132B to respectively engage with the two side segments 120A and 122A. According to an example of construction, the spring 134 can have two opposite ends respectively connected with the two latches 132A and 132B. The spring 134 can be compressed as the two latches 132A and 132B move toward the unlocking state, and expand as the two latches 132A and 132B move toward the locking state.

Referring to FIGS. 1-4, the linking mechanism 140 can operatively couple the latching device 130 to the bottom linkage portion 106 so that a fold of the bottom linkage portion 106 can actuate the latching device 130 and cause its switching from the locking state to the unlocking state. The linking mechanism 140 can include a cable actuator 142, a resilient part 144 and a cable assembly 146. The cable actuator 142 and the resilient part 144 are carried with the standing post 104A and are connected with each other. More specifically, the cable actuator 142 can be movably connected with the standing post 104A at a location adjacent to the foot portion 112A thereof so that the bar segment 110A pivotally connected with the foot portion 112A can interact with the cable actuator 142 during operation. According to an example of construction, the cable actuator 142 can be a single component part, and can be slidably connected with the standing post 104A or the foot portion 112A. For example, the cable actuator 142 can be assembled for sliding upward and downward relative to the standing post 104A and the foot portion 112A.

The resilient part 144 can be exemplarily a coiled spring. The resilient part 144 can have one end connected with the cable actuator 142, and another end connected with the standing post 104A or the foot portion 112A. The resilient part 144 can apply a biasing force on the cable actuator 142 that can bias the cable actuator 142 toward an initial position. For example, the resilient part 144 can be configured to bias the cable actuator 142 to move upward toward the initial position.

Referring to FIGS. 1-4, the cable assembly 146 can extend along the side segment 122A and the standing post 104A with a turn adjacent to the corner bracket 128A, and is respectively connected with the latching device 130 and the cable actuator 142. Accordingly, a movement of the cable actuator 142 away from its initial position can apply a pulling action on the cable assembly 146, which can actuate the latching device 130 and cause its switching from the locking state to the unlocking state.

According to an example of construction, the cable assembly 146 can include a cable 148 and a conduit 150 that are respectively connected with the latches 132A and 132B. More specifically, the conduit 150 can be arranged to extend along the side segment 122A and the standing post 104A with an end 150A of the conduit 150 anchored to the latch 132B and another opposite end 150B of the conduit 150 anchored to the standing post 104A. The cable 148 can extend through an interior of the conduit 150 along the side segment 122A and the standing post 104A, and can have two opposite ends 148A and 148B respectively projecting outward from the ends 150A and 150B of the conduit 150. The end 148A of the cable 148 can be anchored to the latch 132A, and the end 148B of the cable 148 can be anchored to the cable actuator 142.

With the construction described herein, a rotation of the bar segment 110A relative to the foot portion 112A in a folding direction can cause an end E of the bar segment 110A to contact and urge the cable actuator 142 in movement away from its initial position against the biasing force of the resilient part 144. Owing to the coupling of the cable assembly 146, the latching device 130 can be accordingly urged to switch from the locking state to the unlocking state.

Referring to FIGS. 2-4, the bar segment 110A can contact with the cable actuator 142 through a retractable part 152 provided at the end E of the bar segment 110A. The retractable part 152 can move along with the bar segment 110A when the bar segment 110A rotates relative to the standing post 104A and the foot portion 112A, and is movable relative to the bar segment 110A to retract toward the bar segment 110A or extend outward from the bar segment 110A for facilitating an engagement with the cable actuator 142. According to an example of construction, the retractable part 152 can be slidably connected with the bar segment 110A, and can be restricted to slide relative to the bar segment 110A between a retracted position and an extended position. For example, the retractable part 152 can be a plunger slidably connected with the bar segment 110A, which can slide to retract toward a hollow interior of the bar segment 110A or extend outward at the end E of the bar segment 110A. According to an example of construction, the bar segment 110A can be pivotally connected with the foot portion 112A about a shaft 154 that is affixed to the foot portion 112A and is arranged through an elongate slot 156 provided in the retractable part 152, whereby the bar segment 110A and the retractable part 152 carried therewith can rotate in unison about the shaft 154, and a course of the retractable part 152 relative to the bar segment 110A can correspond to a travel of the shaft 154 along the elongate slot 156.

The retractable part 152 can be connected with a spring 158, which can bias the retractable part 152 to protrude outward at the end E of the bar segment 110A. For example, the spring 158 can be disposed inside the bar segment 110A, and can have two opposite ends respectively connected with the retractable part 152 and a fixed structure in the bar segment 110A. Accordingly, the bar segment 110A can rotate relative to the standing post 104A and the foot portion 112A so that the retractable part 152 contacts and urges the cable actuator 142 in movement and thereby cause the latching device 130 to switch from the locking state to the unlocking state.

In conjunction with FIGS. 1-4, FIGS. 5-9 are schematic views illustrating exemplary operation of the latching device 130 and the linking mechanism 140. Referring to FIGS. 1-4, when the infant playpen 100 is in the unfolded state, the two side segments 120A and 122A can generally extend horizontally from the pivot joint 124A, and the two latches 132A and 132B can be respectively engaged with the ends of the two side segments 120A and 122A owing to the biasing force of the spring 134. In the unfolded state, an angle A between the bar segment 110A and the standing post 104A can be equal to about 90 degrees.

Figure 5:
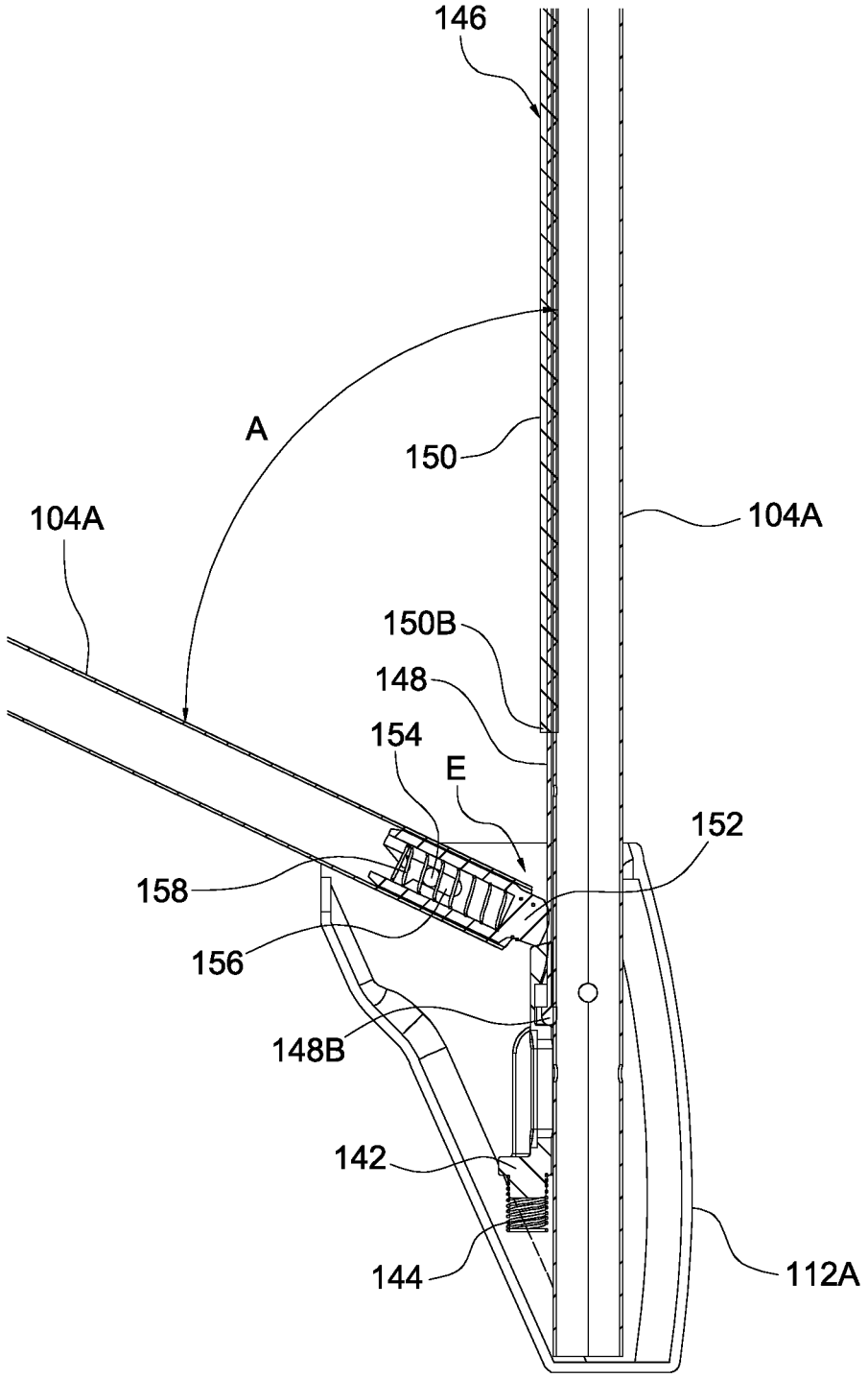
FIG. 5 is a schematic view illustrating an interaction between a bar segment of the bottom linkage portion and a cable actuator carried with a standing post as the bar segment rotates in a folding direction.
Figure 6:
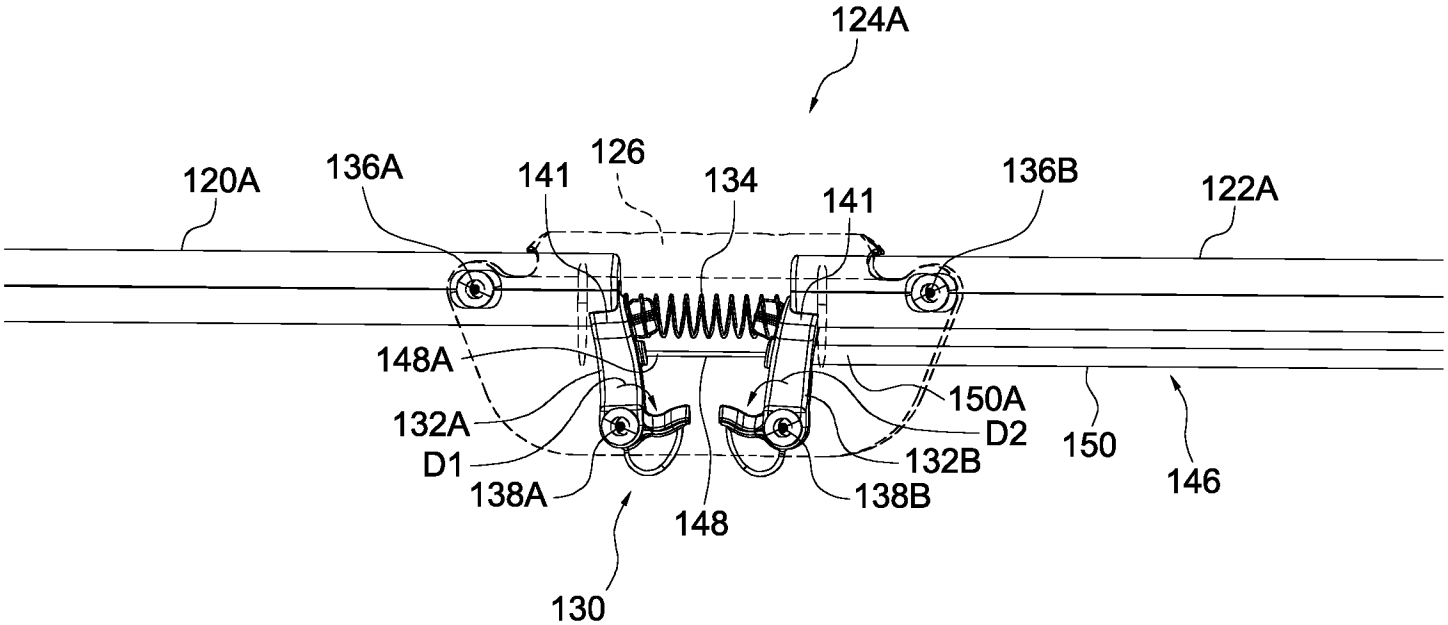
FIG. 6 is a schematic view illustrating an actuation of the latching device for unlocking two side segments of the upper frame portion caused by the rotation of the bar segment in the folding direction.

For folding the infant playpen 100, a caregiver can raise the central hub 108 of the bottom linkage portion 106. As a result, the bar segment 110A rotates about the shaft 154 relative to the standing post 104A and the foot portion 110A in a direction that reduces the angle A between the bar segment 110A and the standing post 104A, as shown in FIG. 5. This rotation can occur with the retractable part 142 in sliding contact with a top of the cable actuator 142. As the angle A approaches 70 degrees, the retractable part 152 at the end E of the bar segment 110A can apply a downward pressure on the cable actuator 142. As a result, the cable actuator 142 can slide downward away from its initial position and apply a pulling action on the cable 148, which slides relative to the conduit 150. Owing to the coupling of the cable assembly 146, the two latches 132A and 132B can accordingly start rotating respectively in direction D1 and D2 toward each other for respectively disengaging from the two side segments 120A and 122A, which is illustrated in FIG. 6. When the angle A reaches approximately 70 degrees, the two latches 132A and 132B can be fully disengaged from the two side segments 120A and 122A. The latching device 130 can be thereby switched to the unlocking state for rotation of the two side segments 120A and 122A.

Figure 7:
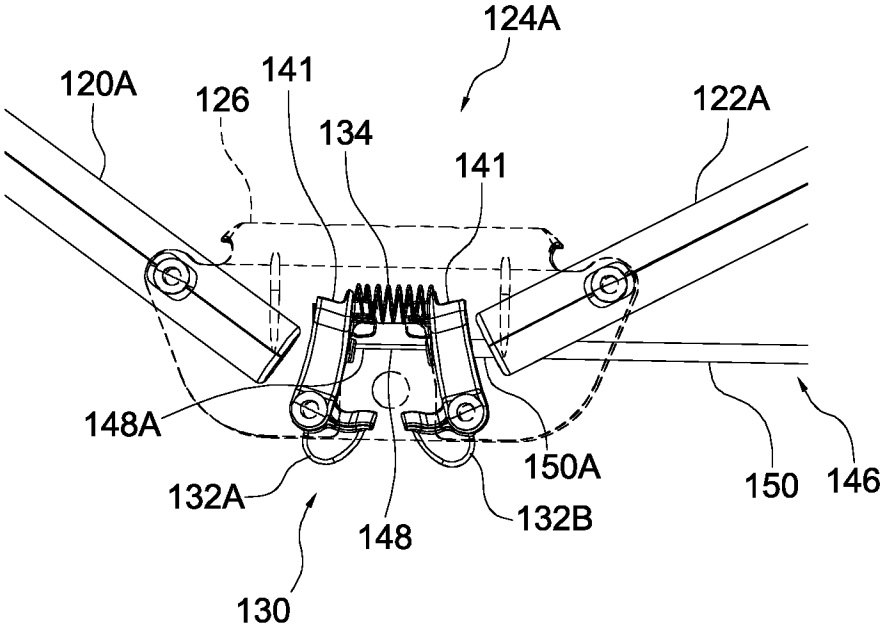
FIG. 7 is a schematic view illustrating the two side segments unlocked and rotating toward a folded state.

Referring to FIG. 7, once the latching device 130 is in the unlocking state, the pivot joint 124A and the latching device 130 carried therewith can drop under gravity. As a result, the two side segments 120A and 122A can respectively rotate relative to the bracket 126 toward the folded state.

Figure 8:
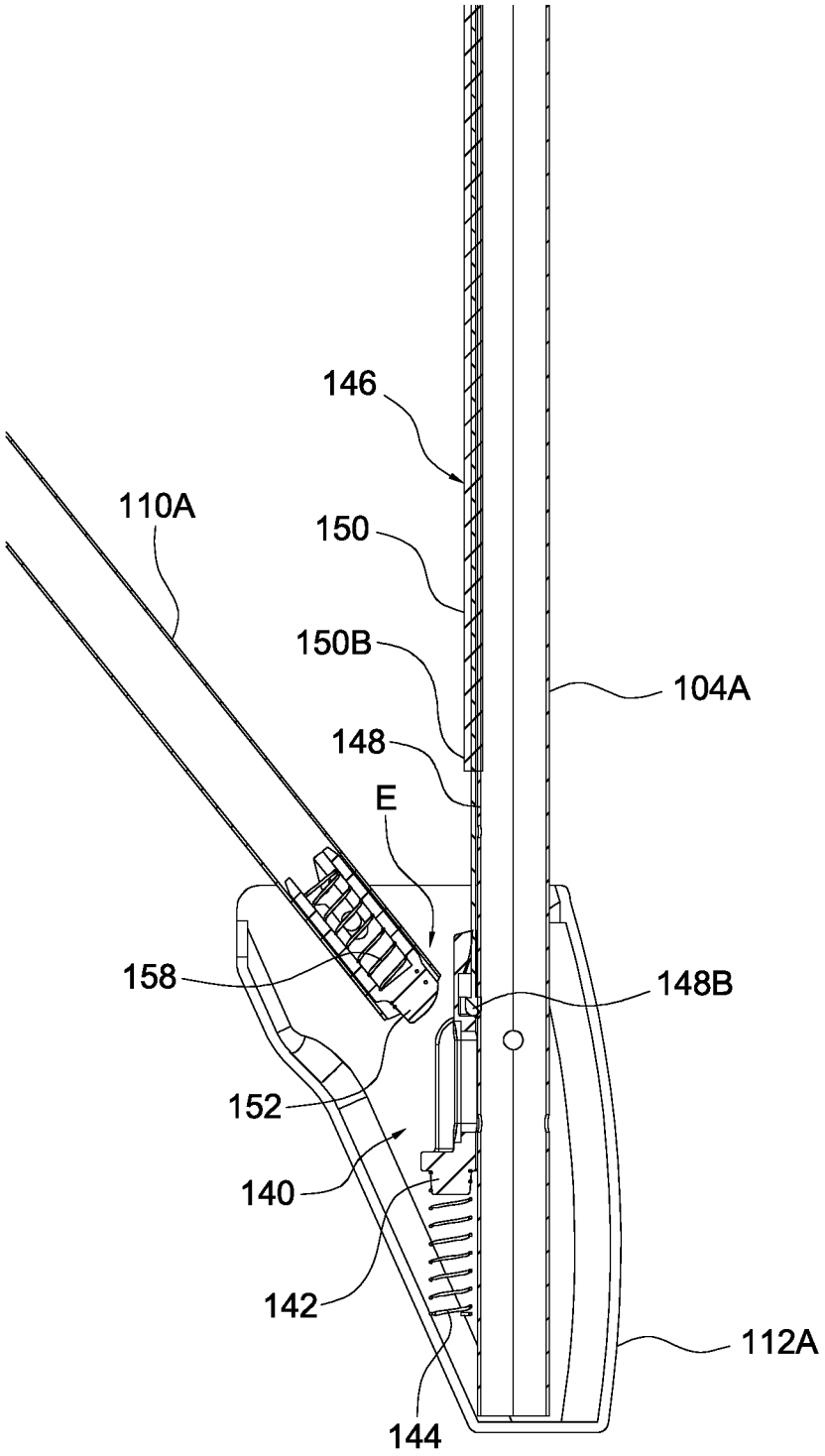
FIG. 8 is a schematic view illustrating the bar segment rotating in a final stage of the folding operation.
Figure 9:
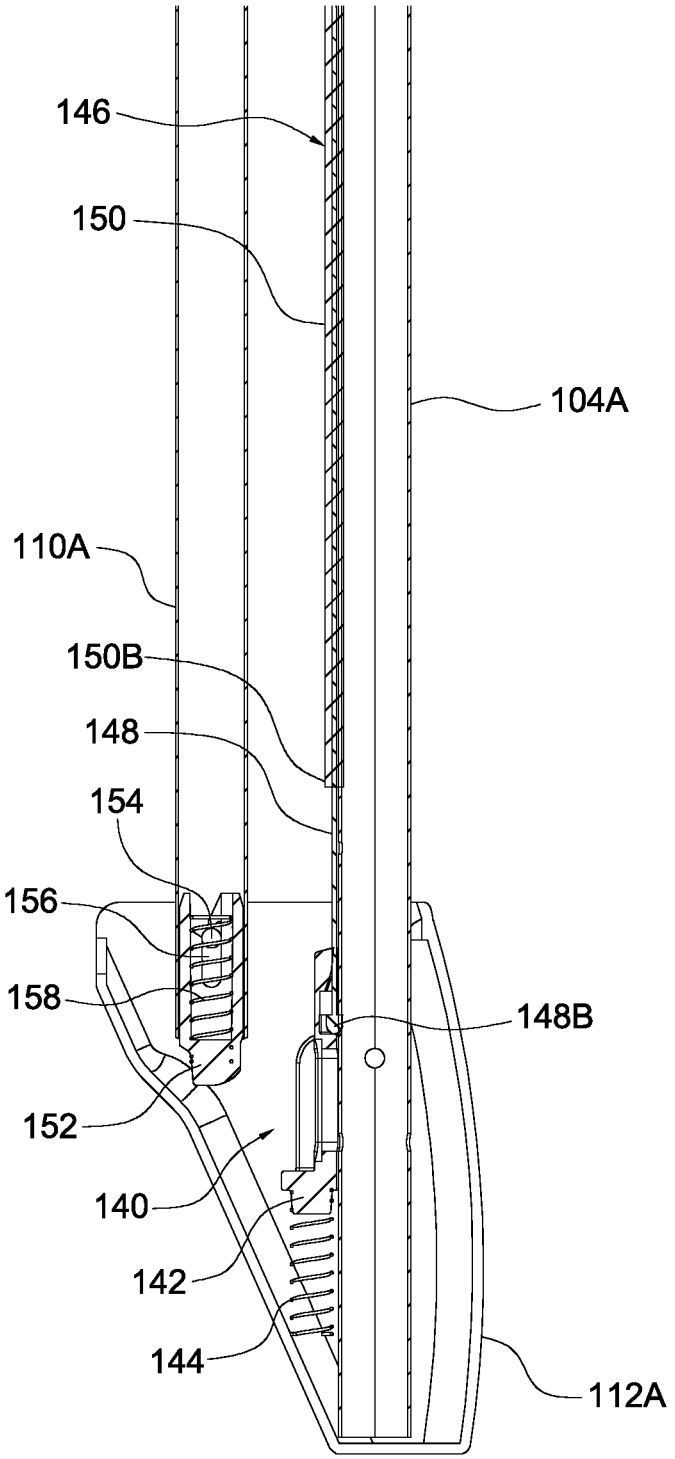
FIG. 9 is a schematic view illustrating the standing post and the bar segment in a position corresponding to a fully folded state of the infant playpen.

Referring to FIG. 8, as the bar segment 110A rotates in a final stage of the folding operation, the retractable part 152 can travel past the top of the cable actuator 142 and move apart from the cable actuator 142. The end E of the bar segment 110A can thus move out of contact with the cable actuator 142 in the final stage of the folding operation. As a result, the cable actuator 142 can slide upward to its initial position under the biasing force of the resilient part 144. When the infant playpen 100 is fully folded, the bar segment 110A can generally extend vertically, and the retractable part 152 at the end E of the bar segment 110A does not contact the cable actuator 142. FIG. 9 illustrates the standing post 104A and the bar segment 110A in a position corresponding to a fully folded state of the infant playpen 100.

When the infant playpen 100 is to be unfolded, the pivot joint 124A can be lifted until the two side segments 120A and 122A are in the unfolded state and locked in position by the latching device 130. As the two side segments 120A and 122A are unfolded, the bar segment 110A can rotate away from the position shown in FIG. 9. To ensure that the bottom linkage portion 106 is properly unfolded, the central hub 108 can be pressed downward so that the bar segment 110A rotates to the horizontal position shown in FIG. 4. As the bar segment 110A rotates toward the horizontal position, the retractable part 152 can contact with the cable actuator 142 and can be urged to retract toward the bar segment 110A, which allows continuous rotation of the bar segment 110A. Once the bar segment 110A reaches the horizontal position of FIG. 4, the retractable part 152 can clear the top of the cable actuator 142, and the spring 158 can urge the retractable part 152 to extend outward from the bar segment 110A and engage with the top of the cable actuator 142.

Referring to FIGS. 1-4, the same latching device 130 described above may be provided at each of the pivot joints 124A, 124B, 124C and 124D, and each latching device 130 may be operatively coupled to the bottom linkage portion 106 via a linking mechanism similar to the linking mechanism 140 described previously. For example, two cable actuators 142 may be respectively provided on the standing posts 104A and 104C, wherein the cable actuator 142 carried by the standing post 104A can be respectively coupled to the latching device 130 of the pivot joint 124A and the latching device 130 of the pivot joint 124B via two cable assemblies 146, and the cable actuator 142 carried by the standing post 104C can be respectively coupled to the latching device 130 of the pivot joint 124C and the latching device 130 of the pivot joint 124D via two other cable assemblies 146. Moreover, each of the bar segments 110A, 110B, 110C and 110D of the bottom linkage portion 106 may respectively include the assembly of the retractable part 152 and the spring 158 as described previously. In this manner, folding of the bottom linkage portion 106 can actuate and switch each of the latching devices 130 from the locking state to the unlocking state in a concurrent manner.

Advantages of the infant playpen described herein include the ability to fold the infant playpen to a compact form. In particular, the infant playpen has an upper frame portion with multiple foldable sides that can be locked in an unfolded state with latching devices, and a bottom linkage portion that can be operatively coupled to the latching devices via a linking mechanism for facilitating folding of the upper frame portion. As the bottom linkage portion is folded by a lifting a central hub thereof, the linking mechanism can actuate and unlock the latching devices so that the upper frame portion can fold with the aid of gravity action. Accordingly, the infant playpen can be conveniently folded with a one-step operation.

Realizations of the infant playpen have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant playpen comprising:

an upper frame portion including a pivot joint and a first and a second side segment, the first and second side segments being rotatable relative to each other between an unfolded state and a folded state;

a latching device disposed adjacent to the pivot joint, the latching device being switchable between a locking state for locking the first and the second side segments in the unfolded state, and an unlocking state for rotation of the first and the second side segments between the unfolded state and the folded state, wherein the latching device includes a first and a second latch, the first latch being engaged with the first side segment and the second latch engaged with the second side segment in the locking state, the first latch being disengaged from the first side segment and the second latch disengaged from the second side segment in the unlocking state;

a standing post connected with the upper frame portion and having a foot portion, the standing post carrying a cable actuator and a resilient part, the resilient part applying a biasing force on the cable actuator for biasing the cable actuator toward an initial position;

a cable assembly respectively connected with the latching device and the cable actuator, wherein the cable assembly includes a conduit, and a cable extending through an interior of the conduit, the cable having two opposite ends respectively anchored to the first latch and the cable actuator, and the conduit having two opposite ends respectively anchored to the second latch and the standing post; and a bottom linkage portion including a bar segment pivotally connected with the foot portion of the standing post, the bar segment being rotatable relative to the foot portion to urge the cable actuator in movement away from the initial position and thereby cause the latching device to switch from the locking state to the unlocking state.

2. The infant playpen according to claim 1, wherein the pivot joint has a bracket that is respectively connected pivotally with the first and second side segments, the first and second side segments being respectively rotatable relative to the bracket between the unfolded state and the folded state.

3. The infant playpen according to claim 2, wherein the first and the second latch are carried with the bracket.

4. The infant playpen according to claim 3, wherein the bar segment is movable to urge the cable actuator in movement and thereby cause a relative movement between the cable and the conduit, which causes the first latch to disengage from the first side segment and the second latch to disengage from the second side segment.

5. The infant playpen according to claim 4, wherein the second side segment and the standing post are respectively connected with a corner bracket, and the cable and the conduit extend along the second side segment and the standing post.

6. The infant playpen according to claim 3, wherein the first latch and the second latch are respectively connected pivotally with the bracket, and the latching device further includes a spring having two ends respectively connected with the first latch and the second latch, the spring biasing the first latch and the second latch to respectively engage with the first side segment and the second side segment.

7. The infant playpen according to claim 1, wherein the cable actuator is slidably connected with the standing post or the foot portion.

8. The infant playpen according to claim 1, wherein an end of the bar segment is provided with a retractable part that is connected with a spring, the retractable part being movable relative to the bar segment to retract toward the bar segment or extend outward from the bar segment, the bar segment being rotatable relative to the foot portion so that the retractable part contacts and urges the cable actuator in movement away from the initial position and thereby cause the latching device to switch from the locking state to the unlocking state.

9. The infant playpen according to claim 8, wherein the retractable part is slidably connected with the bar segment.

10. The infant playpen according to claim 8, wherein the retractable part is out of contact with the cable actuator when the infant playpen is fully folded.

11. The infant playpen according to claim 1, wherein the bottom linkage portion includes a central hub pivotally connected with the bar segment.

12. An infant playpen comprising:

an upper frame portion including a pivot joint, and a first and a second side segment respectively connected pivotally with the pivot joint, the first and second side segments being rotatable relative to each other between an unfolded state and a folded state;

a latching device including a first and a second latch disposed adjacent to the pivot joint, the first latch being engaged with the first side segment and the second latch engaged with the second side segment for locking the first and second side segments in the unfolded state, and the first latch being disengaged from the first side segment and the second latch disengaged from the second side segment for rotation of the first and the second side segments between the unfolded state and the folded state;

a standing post connected with the upper frame portion and having a foot portion, the standing post carrying a cable actuator;

a cable assembly respectively connected with the cable actuator, the first latch and the second latch, the cable assembly extending along the second side segment and the standing post, wherein the cable assembly includes a conduit, and a cable extending through an interior of the conduit, the cable having two opposite ends respectively anchored to the first latch and the cable actuator, and the conduit having two opposite ends respectively anchored to the second latch and the standing post; and a bottom linkage portion including a bar segment pivotally connected with the foot portion of the standing post, the bar segment being rotatable relative to the foot portion to urge the cable actuator in movement and thereby cause the first latch and the second latch to respectively disengage from the first side segment and the second side segment.

13. The infant playpen according to claim 12, wherein the cable actuator is connected with a resilient part, the resilient part applying a biasing force on the cable actuator for biasing the cable actuator toward an initial position, and the bar segment being rotatable relative to the foot portion to urge the cable actuator in movement away from the initial position and thereby cause the first latch and the second latch to respectively disengage from the first side segment and the second side segment.

14. The infant playpen according to claim 12 wherein the bottom linkage portion includes a central hub pivotally connected with the bar segment.

15. The infant playpen according to claim 12, wherein an end of the bar segment is provided with a retractable part that is connected with a spring, the retractable part being movable relative to the bar segment to retract toward the bar segment or extend outward from the bar segment, the bar segment being rotatable relative to the foot portion so that the retractable part contacts and urges the cable actuator in movement and thereby cause the first latch and the second latch to respectively disengage from the first side segment and the second side segment.

* * * * *